United States Patent [19]

Frakes

[11] Patent Number: 4,508,585

[45] Date of Patent: Apr. 2, 1985

[54] APPARATUS FOR FABRICATING COAXIAL CABLE

[76] Inventor: David L. Frakes, 18382 Gothard, Huntington Beach, Calif. 92648

[21] Appl. No.: 469,794

[22] Filed: Feb. 25, 1983

[51] Int. Cl.[3] ..... B65H 81/00

[52] U.S. Cl. ..... 156/393; 156/56; 156/149; 156/172

[58] Field of Search ..... 174/102 R; 156/47, 148, 156/149, 171, 172, 56, 393; 333/239; 29/828

[56] References Cited

U.S. PATENT DOCUMENTS 2,436,421 2/1948 Cork ..... 174/102 R

OTHER PUBLICATIONS

Douglass, W. A., *Braiding and Braiding Machinery,* 1964, pp. 20, 64, 123.

*Primary Examiner*—Marion E. McCamish

*Attorney, Agent, or Firm*—Michael A. Painter

[57] ABSTRACT

The present invention comprises an improved apparatus and method for fabricating coaxial cable. Coaxial cable fabricated in accordance with the present invention comprises an inner conductive member encased in an annular electrical insulator, an outer electrically conducting sheath being annularly disposed about the insulator providing electrical shielding for the inner conductor. The improved apparatus and method for fabricating coaxial cable directs flattened malleable conductive strands for braiding the outer electrical sheath. The individual strands forming the braided sheath are each disposed about a cylindrical bobbin and fed about a pair of directing pins and positioners which position the flattened sheath material for entry into a braiding cone. Denatured alcohol lubricates the braiding cone during the braiding process in order to provide for uniform distribution of the braided sheath about the electrical conductor and insulator.

2 Claims, 5 Drawing Figures

APPARATUS FOR FABRICATING COAXIAL CABLE

BACKGROUND OF THE INVENTION

1. Field of the Invention.

The present invention generally relates to apparatus and processes for manufacturing coaxial cable, and more particularly, to those apparatus and methods for fabricating coaxial cable which employ an outer braided electrical conductor.

2. Prior Art.

The use of coaxial cable for the transmission of high frequency electrical signals and like applications is well known in the art. Coaxial cable typically comprises an inner coaxial conductor which is encased in an annular layer of electrically insulating material. An outer electrical conductor is disposed about the inner insulating cylinder, the outer conducting layer typically being used as a shield, i.e., electrical ground, or for the transmission of low frequency electrical signals. The fabrication of coaxial cable to be employed in high frequency applications requires that the coaxial unit be geometrically accurate. At high frequencies, the electromagnetic energy created by the transmitted signal will tend to be radiated or propagated into space as waves and for this reason, the axial inner conductor must be precisely central within the cylindrical insulator and the outer electrically conducting shield. If this condition is not satisfied, the carrier waves may be reflected back from the cylinder wall, causing distortion in the transmitted signals and "ghost" images in the case of the transmission of signals at frequencies used in television applications. The requirement of geometric precision which is essential to insure good electromagnetic performance of the cable must be fulfilled without undue sacrifice in the flexibility of the cable, a problem which has plagued the apparatus and processes disclosed by the prior art for the fabrication of coaxial cable.

In order to provide coaxial cable which is flexible while maintaining the geometric precision required, a plurality of flattened malleable electrically conductive strands are braided about the coaxial insulating material to form the outer sheath. The problem which has been inherent in the apparatus and devices disclosed by the prior art centers on the manner in which the conducting materials are processed prior to braiding. For economy purposes, conventional cylindrical wire is used as the base material for the outer sheath. Since the material is to be conventionally braided about the electrical insulator, the strands must be flattened in order to provide for the uniform geometrical configuration required by the applications to which the ultimate product is put. The apparatus and methods disclosed by the prior art have not been able to produce geometrically precise coaxial cable without the use of mutliple and disjointed steps which have substantially increased the cost of the ultimate product. The present invention substantially improves upon the apparatus and methods disclosed by the prior art. A conventional carrier apparatus employed in the fabrication of coaxial cable is modified to unify the process of positioning the flattened strands and braiding outer electrical sheaths. The individual flattened strands are disposed about conventional bobbins, the strand being directed about a pair of cylindrical pins mounted upon the carrier. A directional positioner and braiding guide are mounted upon the upper portion of the carrier to direct the flattened strand to the axis of the carrier. The sub-assembly for the coaxial cable comprises the inner conductor and the annular insulating material, this being directed along the inner axis of the carrier. The individual flattened strands are accurately positioned and then braided about the outer surface of the insulating material in a conventional manner, the braiding steps not comprising part of the present invention.

SUMMARY OF THE INVENTION

The present invention comprises an improved apparatus and process for fabricating coaxial cable in order to produce high quality coaxial cable at an economicl price. High quality, coaxial cable used for high frequency applications requires that there be geometric precision in the annular cylindrical layers comprising the inner conductor, the central electrically insulating material and the outer electrically conducting sheath. The present invention is specifically directed to the fabrication of the outer braided sheath for coaxial cable. A conventional high speed carrier for the manufacture of a multi-strand sheath is modified to properly position the flattened sheath strands and direct smae to the braiding cone. The malleable strand is directed about a pair of cylindrical pins, and through a directional positioner and braiding guide which accurately places the strands in the proper position for braiding. As stated, the conventional carrier and braiding equipment and methods do not constitute part of the present invention. Flattened strands are mounted upon the bobbin prior to the braiding process, the positioning guide accurately positioning the flattened strand as it is directed to the braiding cone. Since coaxial cable which is used for the transmission of high frequency electrical signals requires that the sheath be precisely aligned with the inner conductor, the present invention apparatus and process precisely aligns the flattened strand to insure that the geometric alignment of the inner conductor and outer sheath is maintained as the flattened strands are braided about the insulating, annular cylinder.

It is therefore an object of the present invention to provide an improved apparatus and method for fabricating coaxial cable.

It is another object of the present invention to provide an apparatus and method which properly aligns flattened electrical conductors for braiding as the outer sheath of coaxial cable.

It is still yet another object of the present invention to insure that the flattened strand material is accurately positioned for braiding the sheath cylinder for coaxial cable.

It is still yet another object of the present invention to provide an apparatus and method for fabricating coaxial cable which is simple and economic to construct and execute.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only and is not intended as a definition of the limits of the invention.

DESCRIPTION OF THE PRESENTLY PREFERRED EMBODIMENT

Figure 1:
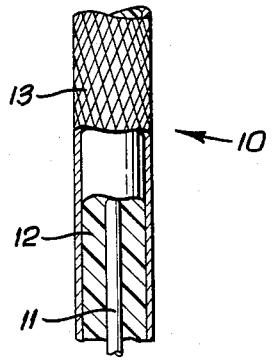
FIG. 1 comprises a partial cross-sectional view of coaxial cable employing an outer braid sheath.

An understanding of the present invention can be gained by an understanding of the requirements for coaxial cable employing an outer braided sheath, the cable assembly being generally designated by the reference numeral 10. Coaxial cable assembly 10 comprises an inner electrical conductor 11 which is typically fabricated from a solid strand of electrical conducting material such as copper. Coaxial cable is typically used for the transmission of high frequency electrical signals. The need for cables such as that shown in FIG. 1 arises from the electromagnetic energy created by the carrier signals. At high frequencies, the electromagnetic energy emanating from the electrical conductor 11 will tend to be propagated into space as waves. As seen in FIG. 1, an annular cylinder of insulating material 12 is uniformly disposed about conductor 11. The outer electrically conducting sheath 13 is the focal point of the present invention. Electrical sheath 13 is fabricated by performing the planetary braiding of a plurality of individual flattened strands of malleable electrically conducting material. Since high frequency signals will cause electromagnetic energy to be radiated outwardly, it is essential to insure that the annular disposition of conductor 11, insulator 12 and electrical sheath 13 are geometrically accurate. The geometrical accuracy required necessitates that conductor 11 be precisely central with insulator 12 and electrical sheath 13. In the absence of such geometrical precision, electromagnetic energy will be reflected back causing distorted electrical transmission (e.g., electromagnetic interference, radio frequency interference, etc.), and in the case of television transmission, will cause "ghost" images. It is therefore clear that the requirement of geometric precision between conductor 11, insulator 12 and outer electrical sheath 13 is a necessity.

Figure 2:
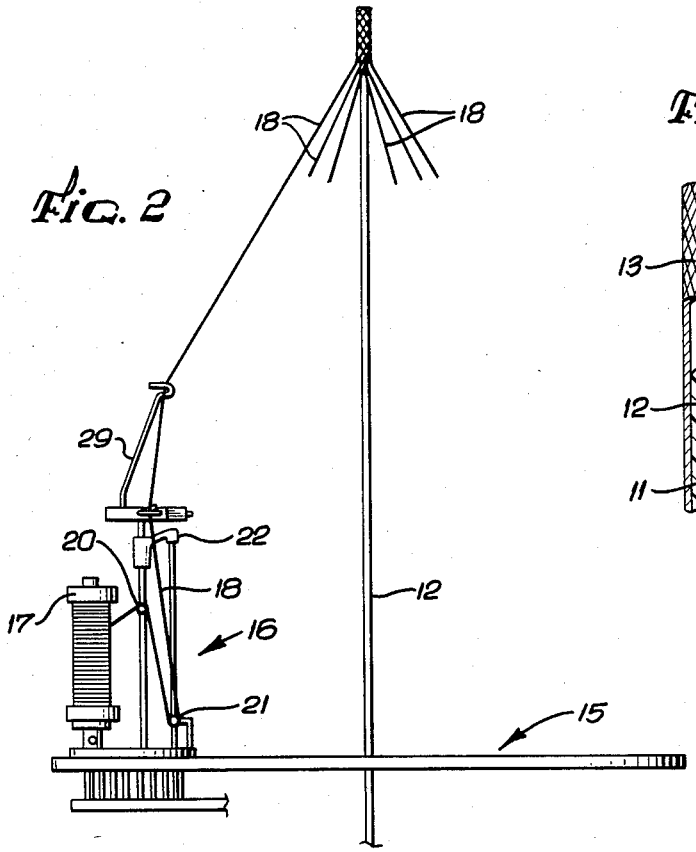
FIG. 2 illustrates a braiding apparatus provided with the improvement of the present invention.

As stated previously, the present invention apparatus and method is directed specifically toward the braiding of flattened individual strands for the formation of braided electrical sheath 13. Referring now to FIG. 2, a conventional high speed carrier for braided strands is illustrated employing the improvement of the present invention apparatus. The basic carrier designated by the reference numeral 15 does not constitute part of the present invention, but is described for the purpose of understanding the present invention. Carrier 15 comprises a plurality of individual members 16 each of which supports a single bobbin 17 of flattened strand material used to fabricate the braided sheath 13. Although the number of members 16 are shown merely for the purpose of illustration, the conventional carrier 15 employs a plurality of such members, each directing a strand 18 of flattened sheath material to be braided about conductor 12. The carrier 15 and the manner in which the strands 18 are braided are well known in the art and are not considered to be part of the present invention.

Figure 3:
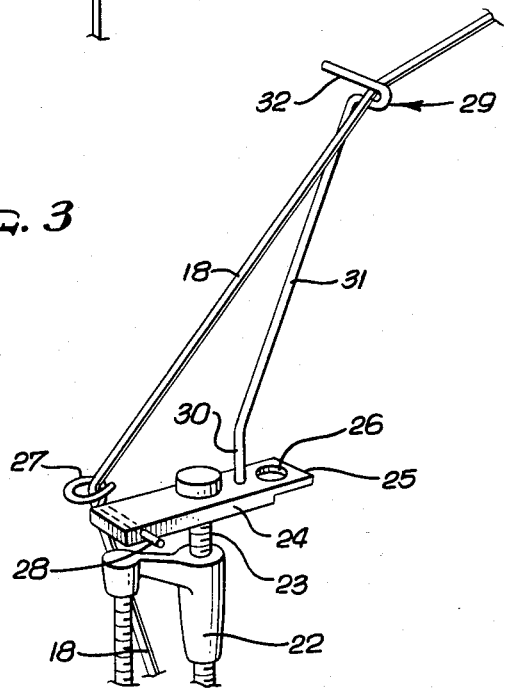
FIG. 3 illustrates a perspective view of the present invention improvement to a carrier for coaxial sheath strands.
Figure 4:
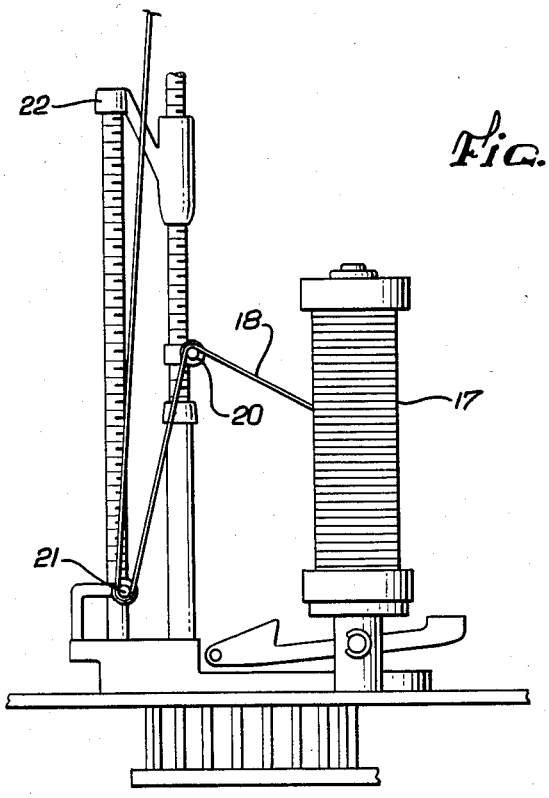
FIG. 4 illustrates a carrier member for mounting a bobbin wrapped with flattened sheath strands.
Figure 5:
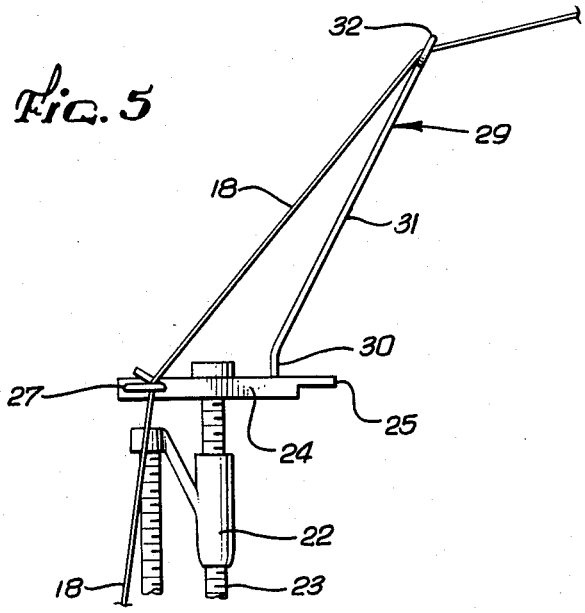
FIG. 5 illustrates a side elevational view of the member shown in FIG. 3.

The improvement to member 16 of the carrier 15 can be best seen by reference to FIGS. 3, 4 and 5 wherein the apparatus used to properly position the plurality of strands 18 can be seen. Carrier member 16 includes positioning pins 20 and 21 which are employed to direct upwardly a single or double supply of preflattened strands 18 which are mounted upon bobbin 17. The upper positioning bracket 22 of member 16 is fitted with mounting shaft 23. Horizontal flange 24 is rotatably coupled about the axis of mounting shaft 23. Terminus 25 of flange 24 is provided with an aperture 26 to permit for adjustments in the positioning of horizontal flange 24. At the end of horizontal flange 24 opposite terminus 25 is directional positioner 27 through which strand 18 is guided. Directional positioner 27 is rotatable about the axis of its mounting shaft 28 to provide for an axis of rotation which is necessary for proper positioning of the flattened strand 18. Flattened strand 18 is directed about positioning pins 20 and 21, through directional positioner 27 and across braiding guide 29 which insures that flattened strand 18 is appropriately positioned and directed to the braiding cone. As can be best seen in FIG. 5, braiding guide 29 is coupled to horizontal flange 24 intermediate mounting shaft 23 and terminus 25. Braidng guide 29 includes a lower mounting member 30 which is integral with upper mounting arm 31. Upper mounting arm 31 is terminated by final guide 32 which provides the final planetary adjustment ot the positioning of the flattened strands 18.

The process of the present invention can include either single or double flattened members 18 which are placed upon bobbin 17 prior to the braiding steps. In addition, during the actual braiding of strands 18 about electrical insulator 12, the location at which the braiding is taking place is continuously lubricated by denatured alcohol or other suitable lubricant to insure that the tension on all braided strands results in a uniform placement of strands relative to one another. It is therefore seen that the present invention provides an improved apparatus and method for the fabrication of coaxial cable which employs an outer braided sheath, the apparatus and method insuring that all sheath strands 18 are properly positioned in a uniform manner prior to the formation of the braided sheath.

I claim:

1. For use with a carrier device for braiding the conductive sheath of coaxial cable, an improved apparatus for positioning a plurality of planetary, flattened, conductive strands, the improvement comprising:

(a) a plurality of mounting shafts coupled to the carrier device;

(b) a pair of cylindrical pins each projecting from one of said mounting shafts;

(c) a horizontal flange rotatably coupled to each of said mounting shafts, said horizontal flange having at one end thereof positioning means for deflecting the position of the flattened conductive strand upwardly from said horizontal flange said positioning means comprising a positioned shaft perpendicular to said horizontal flange and said mounting shaft and being rotatable about an axis, said positioned shaft depending into a directional positioner adapted to receive the flattend conductive strand; and (d) a planetary braiding guide coupled to said horizontal flange on the opposide side of said mounting shaft as said positioning means and extending upwardly from said horizontal flange opposite to said mounting shaft, said braiding guide including means for positioning the flattened conductive strand adjacent the coaxial cable whereby a conductive strand is consecutively disposed about said cylindrical pins through said positioning means and adjacent said braiding guide.

2. The improved apparatus as defined in claim 1 wherein said means for positioning the flattened conductive strand comprises a mounting arm secured to said horizontal flange and extending upwardly therefrom and a strand guide coupled to the upper end of said mounting arm said guide being parallel to the horizontal flange whereby the flattened conductive strand disposed through the directional positioner and across the strand guide.

* * * * *